US006049926A

United States Patent [19]

Amaral

[11] Patent Number: 6,049,926

[45] Date of Patent: Apr. 18, 2000

[54] HEAD CRADLE FOR A THERAPY TABLE

[76] Inventor: Manuel G. Amaral, 8666 N. 108$^{th}$ La., Peoria, Ariz. 85345

[21] Appl. No.: 08/845,808

[22] Filed: Apr. 30, 1997

[51] Int. Cl.$^{7}$ ..... A47C 20/02

[52] U.S. Cl. ..... 5/622; 5/638; 5/643

[58] Field of Search ..... 5/622, 638, 640, 5/643, 507.1

[56] References Cited

U.S. PATENT DOCUMENTS

| | | | |
|---|---|---|---|
| D. 186,932 | 12/1959 | Ritter . | |
| 2,564,323 | 8/1951 | Brown . | |
| 3,114,527 | 12/1963 | Demarest . | |
| 3,188,079 | 6/1965 | Boetcker et al. . | |
| 3,608,103 | 9/1971 | Seid | 5/622 X |
| 4,333,638 | 6/1982 | Gillotti . | |
| 4,620,697 | 11/1986 | Pituon | 5/640 |
| 4,662,361 | 5/1987 | Patterson . | |
| 4,720,881 | 1/1988 | Meyers | 5/640 |
| 4,881,728 | 11/1989 | Hunter . | |
| 5,147,287 | 9/1992 | Jewell et al. . | |
| 5,177,823 | 1/1993 | Riach . | |
| 5,347,668 | 9/1994 | Manning . | |
| 5,427,436 | 6/1995 | Lloyd . | |
| 5,520,623 | 5/1996 | Williams . | |

*Primary Examiner*—Michael F. Trettel
*Attorney, Agent, or Firm*—Halvorson & Venable, P.C.

[57] ABSTRACT

The present invention is a head cradle for supporting the head of an individual during physical or massage therapy. The device of the present invention attaches to an article of furture such as a table and is lockably adjustable in position. The device may be used with individuals who are lying in either the prone position or the supine position. The device of the present invention supports the head of the individual without obstructing the access of the therapist to important portions of the neck and spinal region. A preferred embodiment of the present invention is substantially J shaped and includes a detachable head rest. Furthermore, the present invention includes an accessory tray which is adapted to be used in combination with the head cradle and has a centrally located ointment holder and a projecting towel holder.

18 Claims, 6 Drawing Sheets

HEAD CRADLE FOR A THERAPY TABLE

FIELD OF THE INVENTION

The field of the present invention relates to devices which support an individual's head when using a therapy table. More specifically, the present invention relates to a head cradle which provides support for a patient's head in either the prone or supine position and at the same time allowing a massage or physical therapist maximum flexibility and access to the neck and cervical spine region of the patient.

BACKGROUND

Injury to the neck and cervical spine region is a very common ailment suffered by a large number of people. Whether the condition arose through a car accident, sports or simple every day tension, therapy is often required to alleviate the discomfort and pain. During therapy, it is often necessary that the patient lie in either the prone or supine positions on a table, in order to allow the therapist to work on the patient with maximum flexibility and efficiency.

When using a normal table, both the patient and the therapist face several problems. First, if the patient cannot turn his head, it is very difficult for him to lie in the prone position. In addition, because the patient may be suffering from injury, the typical table is uncomfortable and offers limited support. Furthermore, on the typical table, it is very difficult to adjust the height of the patient's head and the angle at which his head is resting on the table. Finally, on the normal table, the therapist has only limited access to the patient's head and neck regions.

An early solution to the above problems involved a facial opening built into the table that allowed the patient to lie with his face in the opening. Continued patient discomfort eventually to led to the invention of several attachable head support devices at the table end. These devices support the patient's head when it extends beyond the table's edge and were adjustable to meet both the patient's comfort and the ideal working position of the therapist.

By examining the prior art, we find devices such as U.S. Pat. No. 5,520,623 to Williams ("Williams") which discloses a head and face support device for patient's which could not, or should not, move their head to either side. The patient's head is supported by an adjustable face-shaped frame which provides support to both the forehead and the chin. The Williams device is designed for use when the patient is in the prone position only. A base intended to support the patient's chest is connected to the face receiving frame.

U.S. Pat. No. 5,427,436 to Lloyd ("Lloyd") discloses an adjustable headrest utilizing a crescent shaped pad which is connected to a chair or table with a reinforced coupling. The main feature of the Lloyd device is its ability to pivot a person's head around at least two parallel axes. This is accomplished by an adjustable triangular support structure with a short and long arm, both of which are capable of lockable adjustment. A set of rods or posts are utilized to secure the device to the chair or table.

U.S. Pat. No. 5,177,823 to Riach ("Riach") discloses an adjustable head rest designed to attach to the end of a chair or a table to enable the patient to rest in the prone position. The Riach device uses a dual cam locking system for locking and releasing the head rest.

U.S. Pat. No. 4,881,728 to Hunter ("Hunter") discloses a complex head support board and mechanism which attaches to a therapy table. The support board is outfitted with numerous cushions and is attached to a pair of L shaped adjustable arms which extend from the bottom of the table. The L shaped adjustable arms of the Hunter device include a braking mechanism.

A final example is U.S. Pat. No. 3,188,079 to Boetcker et al. ("Boetcker"). Boetcker discloses an adjustable surgical headrest with a crescent shaped pad which is attached to the table by a system of arms and universal joints. This device is designed to provide a safe and stable base for a patient in surgery, but is extremely complicated, difficult to use and expensive to manufacture.

While the above devices may support a patient's head and allow him to lie in a prone position, they do not provide for a supine position nor the ability for the therapist to freely access to the patient's neck and cervical spine region. Specifically, in Williams, Riach and Boetcker et al., the mechanical arms which support the head rest are immediately adjacent the head and neck areas of the patient. Alternately, in Lloyd and Hunter, the head rest itself is bulky enough to obstruct the therapist.

In order to allow maximum access to the patient and maximum convenience to the therapist, a structure is needed for a head cradle where the mechanical parts do not limit the area in which the therapist must work. In addition, a structure is needed which will allow the patient to lie in the supine position. Thus, it is evident that there is a continuing need for improvements in the field.

SUMMARY OF THE INVENTION

It is an object of the present invention to provide a head cradle which attaches to the end of a table and provides horizontal support for a person's head.

It is a further object of the present invention to provide a head cradle which provides support to a patient's head by allowing patients to lie in either the supine or prone position on a head rest cushion resting in a head receiving frame. In order to allow the patient to lie in both face up and face down positions, the head rest cushion comes in two forms, a basic rectangular shape for the supine position and a horseshoe shape for the prone position. The horseshoe head rest cushion allows the patient to rest comfortably and breathe normally in a face down position.

It is still another object of the present invention to provide a head cradle in which the head receiving frame is attached to the end of a table with J shaped arms which are adjustable through a lockable pivot means. By supporting the patient's head with the tail end of the "J", the arms allow a therapist maximum flexibility and maximum access to the neck and cervical spine region of the patient. The lockable pivot means allow the therapist to adjust head rest height with ease while providing both a comfortable and secure setting for a patient.

It is yet another object of the present invention to provide a head cradle which features an attachment in the form of a J shaped tray that provides a convenient setting for the therapist. In addition to allowing the therapist maximum access to the patient's head and neck areas, the J shaped arms double as a convenient storage area for any tools or medical ointments that the therapist needs. The J shaped tray fits right into the J shaped arms of the head cradle and features a slot intended to hold ajar of cream or lotion.

The foregoing and other objectives will become more apparent after consideration of the following detailed description taken, in conjunction with the accompanying drawings, in which a preferred form of this invention is illustrated.

BRIEF DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION OF PREFERRED EMBODIMENTS

Figure 1:
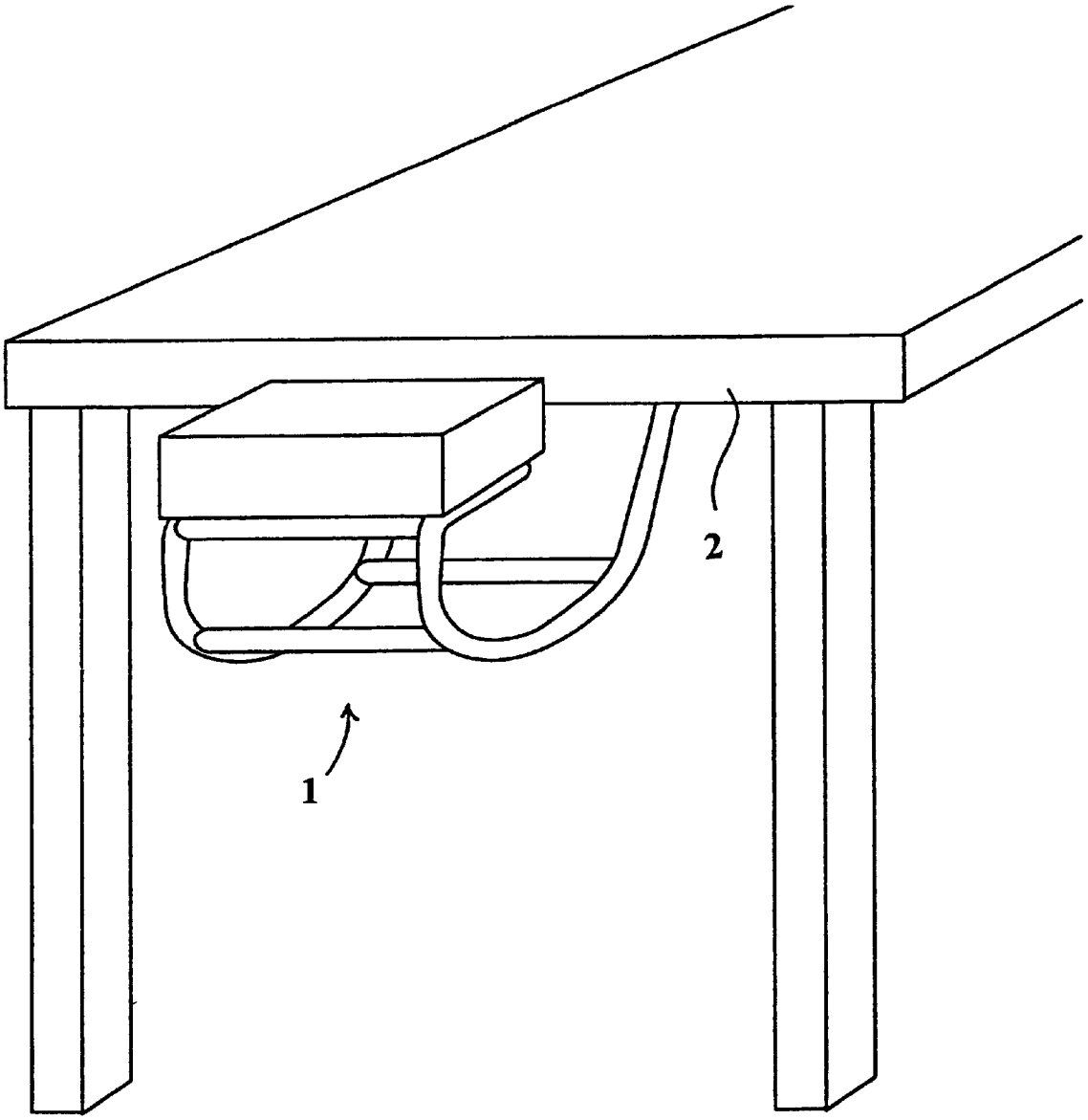
FIG. 1 is a plan view of the present invention in use with a table.
Figure 2B:
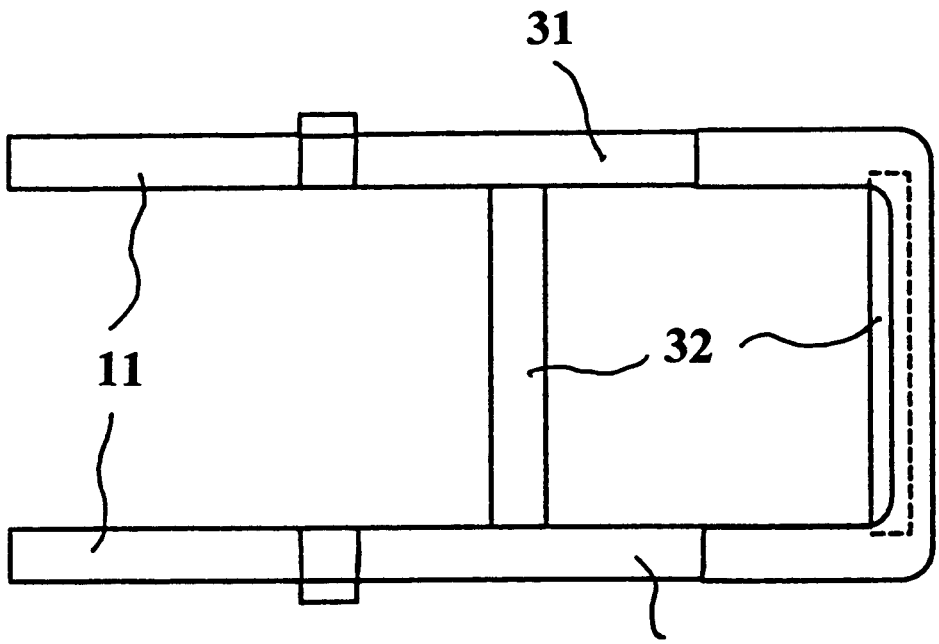
FIG. 2*b* is a top view of an accessory shelf of the present invention without the headrest.
Figure 2A:
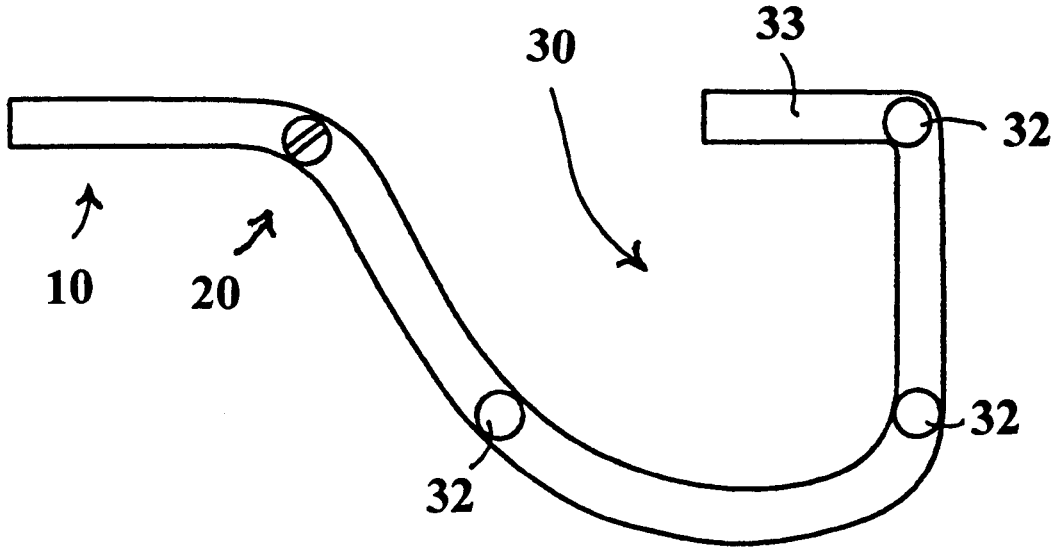
FIG. 2*a* is a side view of an accessory shelf of the present invention without the headrest.
Figure 3A:
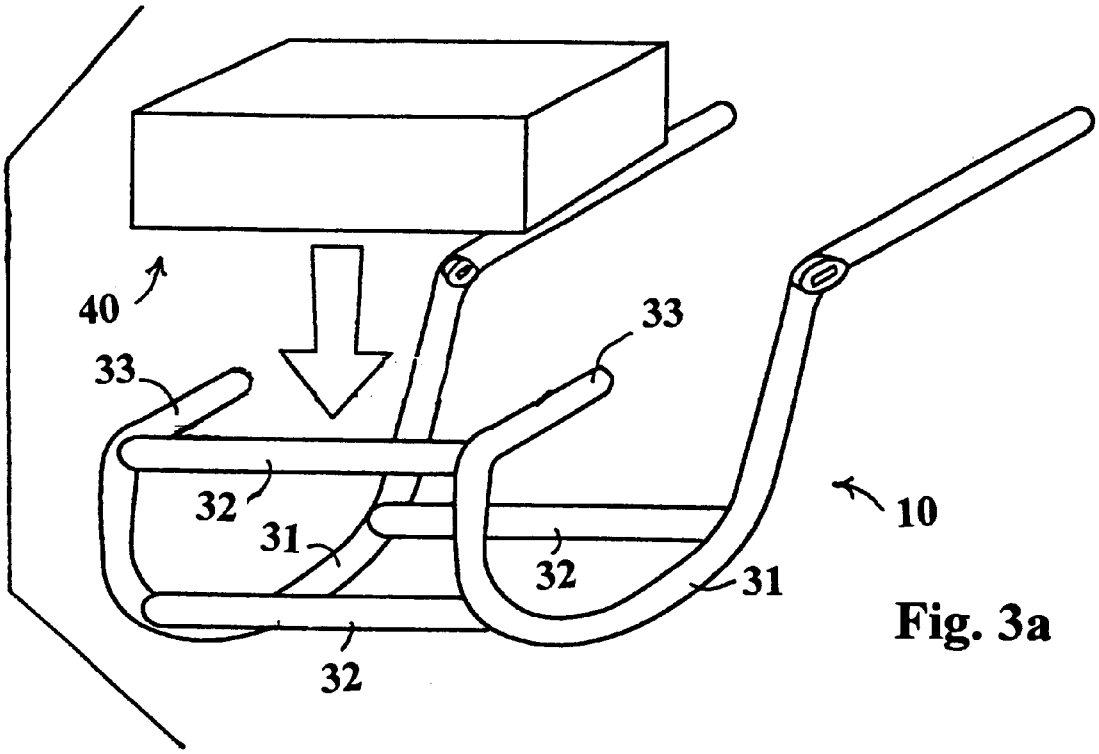
FIG. 3*a* is an exploded view of the present invention showing how the head cushion attaches to the frame.
Figure 3B:
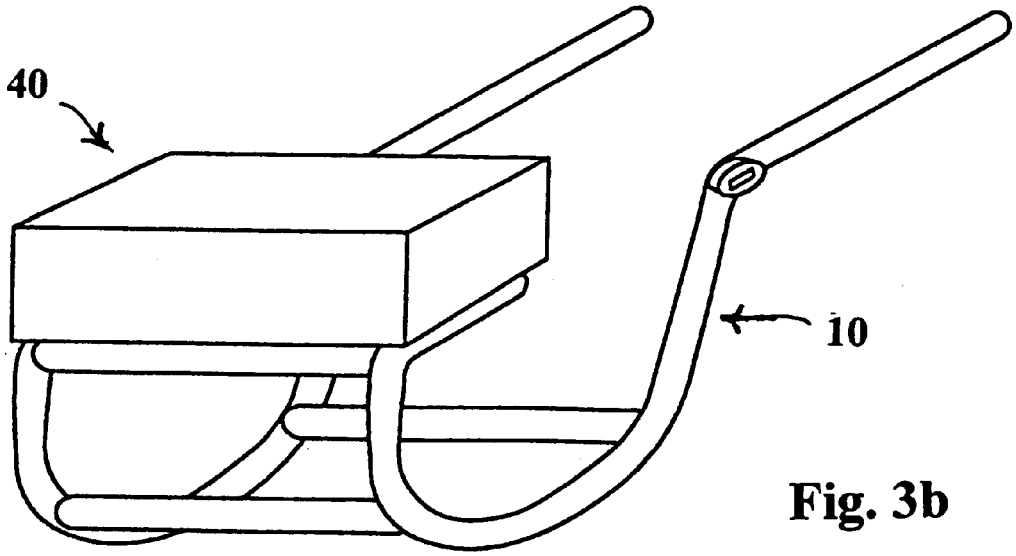
FIG. 3*b* is an illustration of the present invention showing where the head cushion attaches to the frame.
Figure 4A:
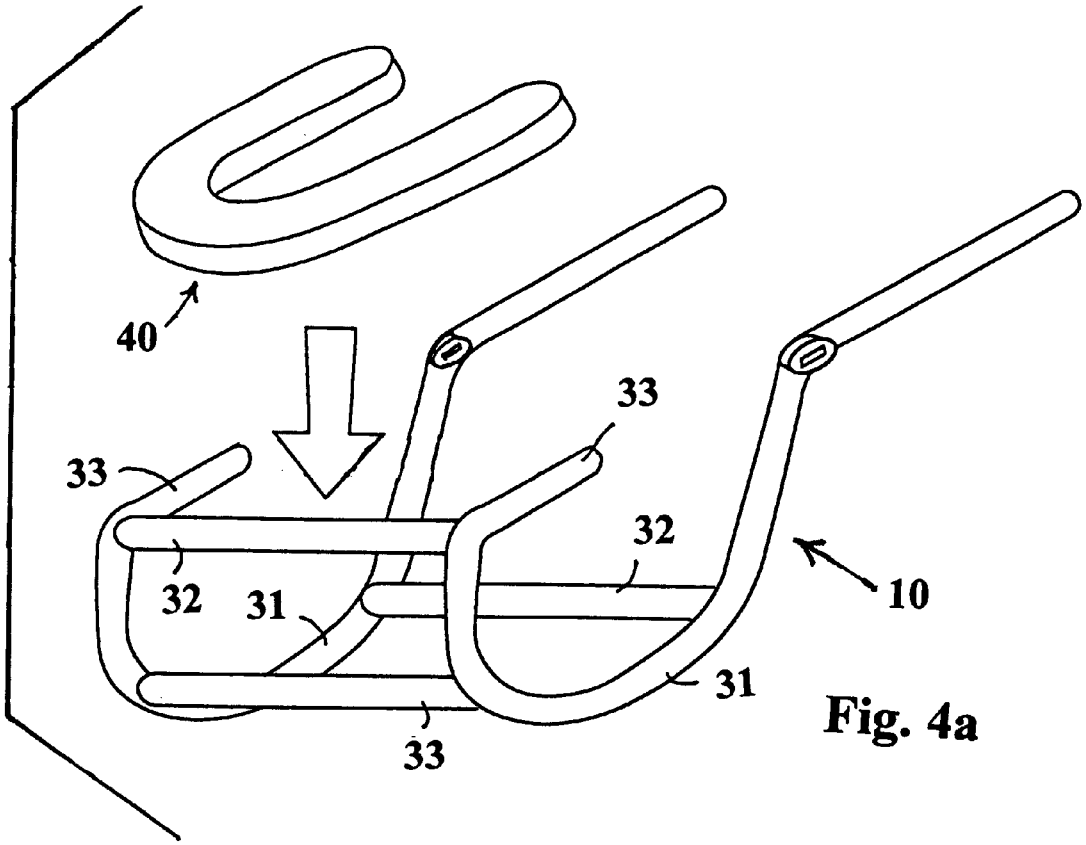
FIG. 4*a* is an exploded view of the present invention showing how the U-shaped head cushion attaches to the frame.
Figure 4B:
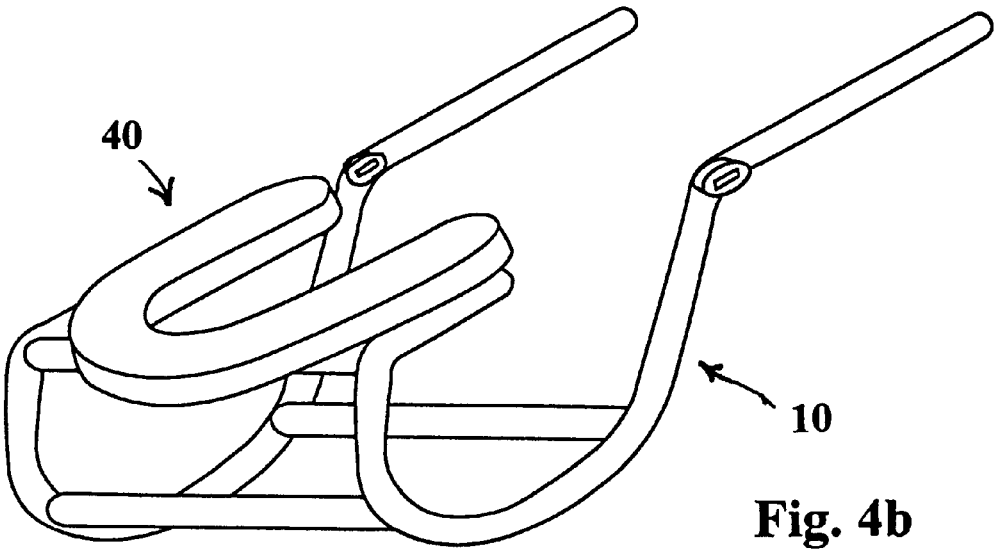
FIG. 4*b* an illustration of the present invention showing where the U-shaped head cushion attached to the frame.
Figure 5B:
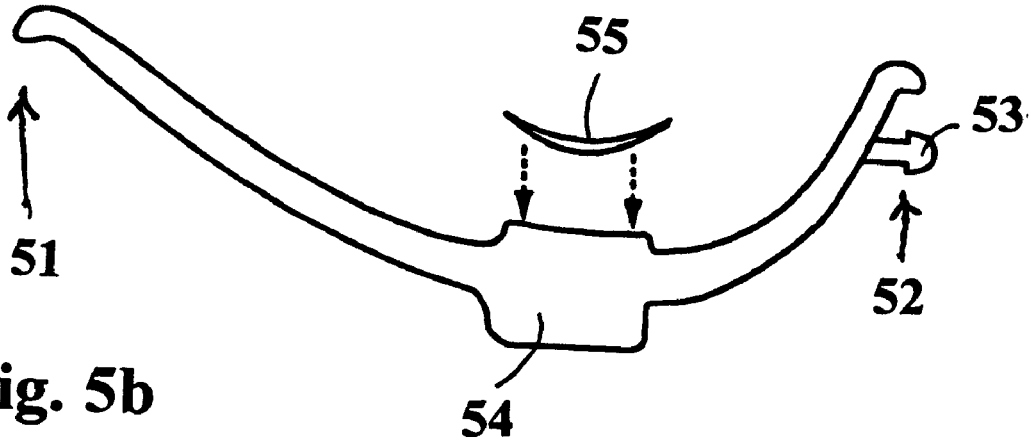
FIG. 5*b* is a side view of the accessory tray of the present invention.
Figure 5A:
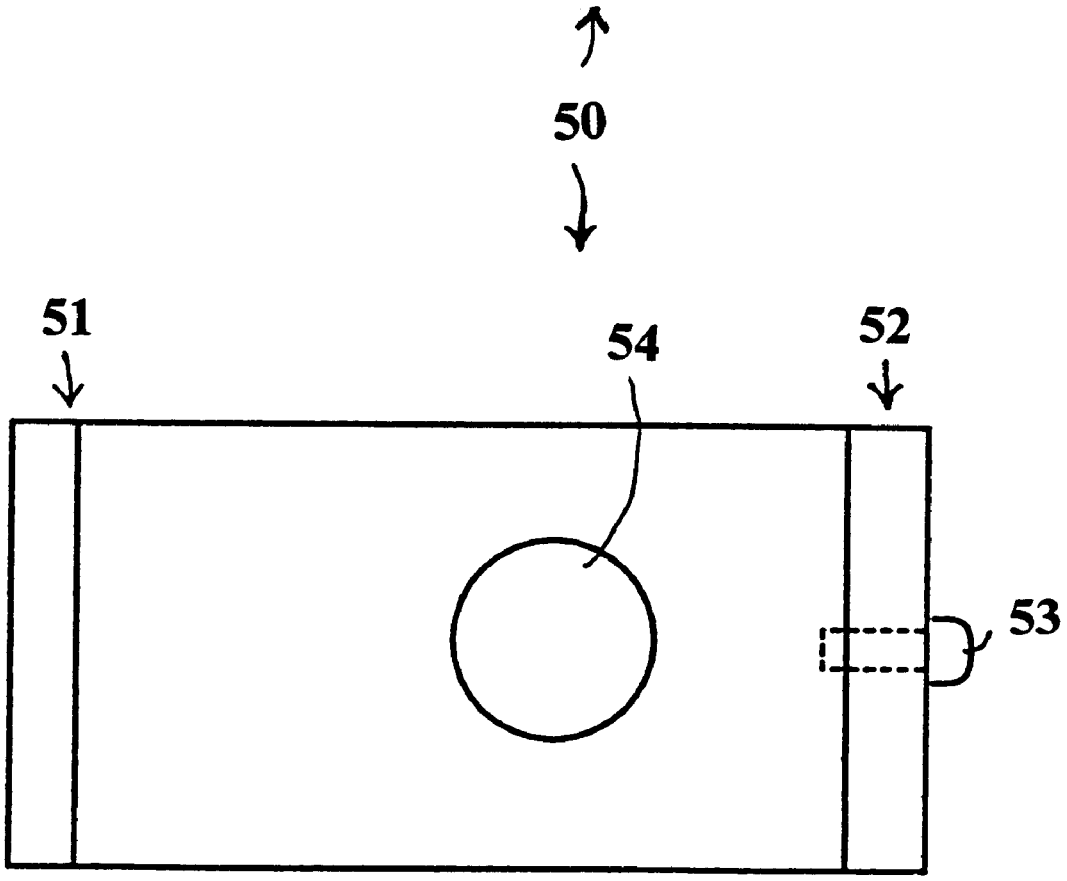
FIG. 5*a* is a top view of the accessory tray of the present invention.
Figure 6:
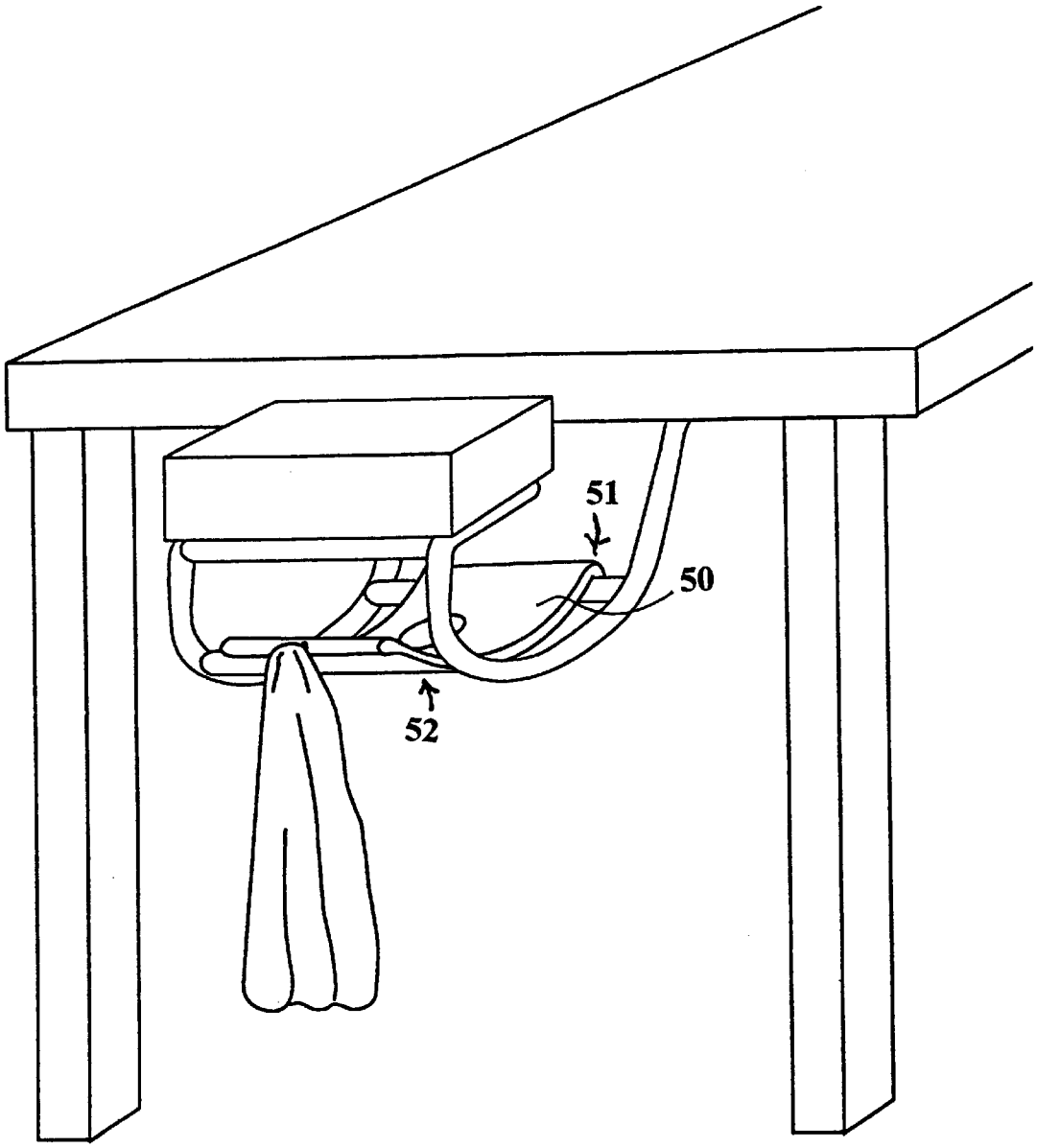
FIGS. 6 is the present invention attached to a therapy table, illustrating use of the accessory shelf.

The present invention is a head cradle 1 for an article of furniture, such as a table 2. The head cradle 1 is removably secured to the table 2, and is used to provide a patient with a comfortable and secure setting for massage or physical therapy. The head cradle 1 allows the patient's head to be adjustable in height in either the supine or prone position. Furthermore, the head cradle 1 allows the therapist maximum and convenient access to the patient's neck and cervical spine region.

The head cradle 1 is comprised of an attachment means 10 adapted to releasably attach the head cradle 1 to the table 2, a lockable pivot means 20, a support frame 30 attached to the attachment means 10 by the lockable pivot means 20, a head rest 40 which attaches to the support frame 30 and an accessory tray 50 which is adapted to be attachable to the head cradle 1. Preferably, the invention is formed of a light weight and rigid material, for easy installment and also in order to give the patient maximum security and comfort.

The attachment means 10 preferably consists of a pair of support rods 11 which attach by brackets or are directly inserted into apertures located on an edge of the table 2. In the preferred embodiment, the rods 11 are inserted into two apertures provided in the table 2.

Located at a distal end of each support rod 11 is a lockable pivot means 20, such as a ratchet pivot or a spring biases cam, which allows lockable adjustment to the height and angle of the support frame 30 and the head rest 40. The support frame 30 of the head cradle 1 is placed into a desired orientation relative to the table 2 and the lockable pivot 20 is tightened, thus locking the support frame 30 into the desired orientation. It should be recognized that any suitable alternate form of a lockable pivot means 20 is also considered to fall within the scope of the present invention.

The support frame 30, which is attached to the lockable pivot means 20, is comprised of two substantially parallel arms 31 and at least one transverse rod(s) 32 interconnecting the arms 31. In the preferred embodiment, there are three transverse rods 32, two of which are lower rods which defining a plane, while the remaining rod is located near a distal end of the support frame 30 and is located substantially above one of the lower two rods. The support frame 30 provides head support which is non-obstructing to the therapist, thus allowing maximum flexibility of support and maximum access to the patient's neck and cervical spinal region.

The arms 31 attach to the lockable pivot means 20 and extends downward from the pivot means 20, then curves upward to end at a substantially horizontal flat tail end 33. The flat tail end 33 is adapted to receive the head rest 40. It can be seen that the entire ensemble, attachment means 10, pivot means 20 and support frame 30 substantially form a "J" shape. Alternate shapes may be formed and considered within the scope of the present invention as long as the shapes do not substantially interfere with the therapists access to the patient.

The head rest 40 is comprised of a cushion which, in the preferred embodiment, is a rectangular shaped head piece cushion for the supine position and a horseshoe shaped head piece cushion for the prone position. The horseshoe headpiece cushion allows the patient to lie face down in comfort, allowing normal breathing. These cushions have a stiff internal core or support and are preferably made of padded material such as upholstered sponge or foam rubber. Alternate shapes such as a rectangular shape, a square shape, a circular shape, an oval shape, a triangular shape, a ring shape, and an oval toroid shape are considered to fall within the scope of the present invention.

A primary accessory which works in combination with the head cradle 1 is the accessory tray 50. Preferably, the tray 50 conforms to a portion of the shape of the support frame 30. The tray 50 aids the therapist by holding frequently used items, in particular treatment creams and ointments. The tray 50 has first and second ends, 51 and 52, which are adapted to clamp over the lower two of the three transverse rods 32. Moreover, the tray 50 has a towel holder 53 which in the preferred embodiment is located at either the first or second end, 51 or 52. The towel holder 53 may be a hook or a rod, but is, at least, a projection adapted to hold a towel. Finally, the tray 50 is equipped with a centrally located ointment holder 54. The ointment holder 54 is adapted to receive jars and the like which contain creams and ointments which form a part of the physical therapy routine. Additionally, the ointment holder 54 may hold an ointment dish 55 which may hold a portion of the ointment in place of the entire ointment jar.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein in intended to be illustrative only and is not intended to be limitative. Rather, the scope of the invention described herein is limited only by the claims appended hereto.

What is claimed is:

1. A head cradle for use with an article of furniture comprising:

a) an attachment means with a first end and a second end, the first end being adapted to removably attach the head cradle to the article of furniture;

b) a pivot means located at the second end of the attachment means;

c) a support frame attached at a proximate end to the pivot means; and d) the support frame further comprises a pair of substantially parallel arms which are interconnected by at least one transverse rod; and e) the substantially parallel arms initially extend downward from the pivot means and then curve upward to terminate at a substantially flat tail end; and d) a head rest which is attachable to the substantially flat tail end of the support frame.

2. A head cradle for use with an article of furniture comprising:

a) an attachment means comprising a pair of support rods, each with a first end and a second end, the first end being adapted to removably attach the head cradle to the article of furniture;

b) a pivot means located at the second end of the attachment means;

c) a support frame attached at a proximate end to the pivot means; and d) a head rest which is attachable to a distal end of the support frame;

wherein the pair of support rods, attached pivot means and attached support frame form a J shape.

3. The head cradle of claim 2 wherein the pivot means is a lockable pivot means.

4. The head cradle of claim 3 wherein the head rest is releasably attachable to a flat tail end of the support frame.

5. The head cradle of claim 4 wherein the head rest further comprises an internal rigid support and an external upholstered cushion and the shape of the head rest is a rectangular shape.

6. The head cradle of claim 4 wherein the head rest further comprises an internal rigid support and an external upholstered cushion and the shape of the head rest is a horseshoe shape.

7. A head cradle for use with an article of furniture comprising:

a) an attachment means with a first end and a second end the first end being adapted to removably attach the head cradle to the article of furniture;

b) a lockable pivot means located at the second end of the attachment means;

c) a support frame attached at a proximate end to the pivot means; and d) an accessory tray which is adapted to be received by the head cradle; and e) a head rest that is releasably attachable to a distal end of the support frame.

8. The head cradle of claim 7 wherein the support frame further comprises a pair of substantially parallel arms which are rigidly interconnected by three transverse rods, the three transverse rods further comprises a pair of lower transverse rods which define a plane and a remaining terminal transverse rod which is located near a distal end of the parallel arms.

9. The head cradle of claim 8 wherein the accessory tray further has a first end and a second end, the first and second ends being adapted to releasably attach to the lower pair of transverse rods.

10. The head cradle of claim 9 wherein the accessory tray further has an ointment holder which is centrally located on the accessory tray.

11. The head cradle of claim 10 wherein the accessory tray further has a projecting towel holder.

12. A head cradle for use with an article of furniture comprising:

an attachment means with a first end and a second end, the first end being adapted to removably attach the head cradle to the article of furniture;

b) a lockable pivot means located at the second end of the attachment means;

c) a support frame attached at a proximate end to the pivot means;

d) a head rest which is releasably attachable to a distal end of the support frame; and in combination e) an accessory tray which is adapted to be used with the head cradle.

13. The head cradle of claim 12 wherein the support frame further comprises a pair of substantially parallel arms which are rigidly interconnected by three transverse rods, the three transverse rods further comprises a pair of lower transverse rods which define a plane and a remaining terminal transverse rod which is located near a distal end of the parallel arms.

14. The head cradle of claim 13 wherein the accessory tray further has a first end and a second end, the first and second ends being adapted to releasably attach to the lower pair of transverse rods.

15. The head cradle of claim 14 wherein the accessory tray further has an ointment holder which is centrally located on the accessory tray.

16. The head cradle of claim 15 wherein the pair of support rods, attached pivot means and attached support frame form a J shape.

17. The head cradle of claim 16 wherein the head rest further comprises an internal rigid support and an external upholstered cushion and the shape of the head rest is a rectangular shape.

18. The head cradle of claim 16 wherein the head rest further comprises an internal rigid support and an external upholstered cushion and the shape of the head rest is a horseshoe shape.

* * * * *